US010612276B2

(12) United States Patent
Nozawa et al.

(10) Patent No.: US 10,612,276 B2
(45) Date of Patent: Apr. 7, 2020

(54) VEHICLE DOOR LATCH DEVICE

(71) Applicant: MITSUI KINZOKU ACT CORPORATION, Kanagawa (JP)

(72) Inventors: Hideaki Nozawa, Kanagawa (JP); Tomoharu Nagaoka, Kanagawa (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 285 days.

(21) Appl. No.: 15/522,540

(22) PCT Filed: Dec. 12, 2014

(86) PCT No.: PCT/JP2014/083011
§ 371 (c)(1),
(2) Date: Apr. 27, 2017

(87) PCT Pub. No.: WO2016/067480
PCT Pub. Date: May 6, 2016

(65) Prior Publication Data

US 2017/0314300 A1 Nov. 2, 2017

(30) Foreign Application Priority Data

Oct. 29, 2014 (JP) ..... 2014-220837

(51) Int. Cl.
*E05B 79/08* (2014.01)
*E05B 81/66* (2014.01)
(Continued)

(52) U.S. Cl.
CPC ..... *E05B 79/08* (2013.01); *E05B 17/2069* (2013.01); *E05B 77/54* (2013.01);
(Continued)

(58) Field of Classification Search
CPC ..... E05B 81/16; E05B 81/20; E05B 81/64; E05B 81/66; E05B 81/72; E05B 81/74; E05B 85/02; E05B 85/06; E05B 79/08
See application file for complete search history.

(56) References Cited

U.S. PATENT DOCUMENTS 4,762,348 A * 8/1988 Matsumoto ..... E05B 81/20 292/201
5,618,068 A 4/1997 Mitsui et al.
(Continued)

FOREIGN PATENT DOCUMENTS

CN 103527014 A 1/2014
CN 104100155 A 10/2014
(Continued)

OTHER PUBLICATIONS

Extended European Search Report issued in corresponding European Patent Application No. 14905051.0-1005 / 3214241, dated Jun. 13, 2018.
(Continued)

*Primary Examiner* — Alyson M Merlino
(74) *Attorney, Agent, or Firm* — McDermott Will & Emery LLP

(57) ABSTRACT

A vehicle door latch device includes: an interlocking unit assembly including an interlocking mechanism; and an operating unit assembly including an operating mechanism. The interlocking unit assembly includes a latch configured to be rotatable to a latched position from an open position via a half closed door position by interlocking with the striker. The operating unit assembly includes: a casing, in which the interlocking unit assembly is fitted, and in which the operating mechanism is installed; and a switch plate, on which a half closed door detection switch and an electric wiring connected to the half closed door detection switch are installed, and which is integrally installed in the casing, the
(Continued)

half closed door detection switch having a switch pin configured to abut against the latch. A plane of rotation of the latch and a plate surface of the switch plate intersect each other orthogonally.

3 Claims, 14 Drawing Sheets

(51) Int. Cl.

| | |
|---|---|
| ***E05B 85/02*** | (2014.01) |
| ***E05B 17/20*** | (2006.01) |
| ***E05B 77/54*** | (2014.01) |
| ***E05B 81/16*** | (2014.01) |
| ***E05B 85/06*** | (2014.01) |
| *E05B 81/20* | (2014.01) |
| *E05B 81/64* | (2014.01) |

(52) U.S. Cl.
CPC ..... *E05B 81/16* (2013.01); *E05B 81/66* (2013.01); *E05B 85/02* (2013.01); *E05B 85/06* (2013.01); *E05B 81/20* (2013.01); *E05B 81/64* (2013.01)

(56) References Cited

U.S. PATENT DOCUMENTS

| | | | | | |
|---|---|---|---|---|---|
| 5,678,869 | A * | 10/1997 | Yoshikuwa | E05B 81/66 | 292/216 |
| 6,059,328 | A * | 5/2000 | Gomi | E05B 77/34 | 292/216 |
| 6,349,983 | B1 * | 2/2002 | Dupont | E05B 81/14 | 292/201 |
| 6,390,516 | B1 * | 5/2002 | Kobayashi | E05B 81/20 | 292/201 |
| 6,409,233 | B1 * | 6/2002 | Hanaki | E05B 81/20 | 292/144 |
| 6,637,783 | B2 * | 10/2003 | Takamura | E05B 81/14 | 292/201 |
| 6,698,804 | B2 * | 3/2004 | Shiota | E05B 81/20 | 292/201 |
| 9,290,969 | B2 * | 3/2016 | Yokota | E05B 81/20 | |
| 2001/0005079 | A1 * | 6/2001 | Takamura | E05B 81/20 | 292/201 |
| 2002/0167179 | A1 * | 11/2002 | Takamura | E05B 81/20 | 292/201 |
| 2005/0218662 | A1 * | 10/2005 | Umino | E05B 81/16 | 292/216 |
| 2010/0117379 | A1 * | 5/2010 | Mitchell | E05B 77/06 | 292/216 |
| 2012/0061977 | A1 * | 3/2012 | Takeda | E05B 81/20 | 292/201 |
| 2013/0049379 | A1 * | 2/2013 | Yokota | E05B 81/20 | 292/129 |
| 2014/0001778 | A1 | 1/2014 | Yokomori et al. | | |
| 2014/0225382 | A1 * | 8/2014 | Kurita | E05B 81/20 | 292/201 |
| 2015/0115617 | A1 * | 4/2015 | Powell | E05B 81/66 | 292/117 |
| 2015/0240534 | A1 | 8/2015 | Kuriyama et al. | | |
| 2015/0361694 | A1 * | 12/2015 | Zeabari | E05B 85/02 | 361/752 |
| 2016/0040457 | A1 | 2/2016 | Yokomori et al. | | |
| 2016/0076277 | A1 * | 3/2016 | Kouzuma | E05B 81/16 | 292/201 |
| 2016/0123046 | A1 * | 5/2016 | Nozawa | E05B 79/08 | 292/200 |
| 2016/0290016 | A1 * | 10/2016 | Enomoto | E05B 81/66 | |
| 2017/0268264 | A1 * | 9/2017 | Suzumura | E05B 77/34 | |
| 2017/0370130 | A1 * | 12/2017 | Kimura | E05B 81/16 | |

FOREIGN PATENT DOCUMENTS

| | | | | | |
|---|---|---|---|---|---|
| EP | 0894920 | A1 * | 2/1999 | E05B 81/64 | |
| EP | 2 792 829 | A2 | 10/2014 | | |
| GB | 2336400 | A * | 10/1999 | E05B 81/66 | |
| JP | H07-034743 | A | 2/1995 | | |
| JP | H10-148051 | A | 6/1998 | | |
| JP | 4765123 | B2 | 9/2011 | | |
| JP | 2012-233318 | A | 11/2012 | | |
| JP | 2013-108307 | A | 6/2013 | | |
| JP | 2014-009475 | A | 1/2014 | | |
| WO | 2014/041958 | A1 | 3/2014 | | |
| WO | WO-2016084786 | A1 * | 6/2016 | E05B 81/16 | |
| WO | WO-2017047143 | A1 * | 3/2017 | E05B 81/16 | |

OTHER PUBLICATIONS

Chinese Office Action issued in corresponding Chinese Patent Application No. 201480082920.0, dated Aug. 3, 2018, with English Translation.

International Search Report issued in Application No. PCT/JP2014/083011, dated Jan. 27, 2015.

* cited by examiner

VEHICLE DOOR LATCH DEVICE

RELATED APPLICATIONS

This application is the U.S. National Phase under 35 U.S.C. § 371 of International Application No. PCT/JP2014/083011, filed on Dec. 12, 2014, which in turn claims the benefit of Japanese Application No. 2014-220837 filed on Oct. 29, 2014, the disclosures of which are incorporated by reference herein.

FIELD

The present invention relates to a vehicle door latch device.

BACKGROUND

Door latch devices for vehicles include those, each in which an interlocking unit assembly is integrated with an operating unit assembly; the interlocking unit assembly including a body fixed to a door and made of synthetic resin, a latch accommodated in the body and engageable with a vehicle body side striker, and an interlocking mechanism, such as a pole engageable with the latch; and the operating unit assembly including a casing fixed to a reverse side of the body and made of synthetic resin, and an operating mechanism, which is installed in the casing, and which is able to switch over the door between a locked state and an unlocked state by the interlocking mechanism being operated (see, for example, Patent Literatures 1 and 2).

Further, some door latch devices include a half closed door detection switch that detects a half closed state of the door by detecting the position of the latch.

Furthermore, some door latch devices include a switch plate, on which electrically operating parts, such as a switch and a motor installed in the operating unit assembly, are mounted, and which is integrally installed with the casing of the operating unit assembly.

CITATION LIST

Patent Literature

Patent Literature 1: Japanese Patent No. 4765123

Patent Literature 2: Japanese Laid-open Patent Publication No. 2012-233318

SUMMARY

Technical Problem

In recent years, automatic assembly has been performed in order to improve assembly efficiency of door latch devices, and further improvement in the assembly efficiency has been demanded. Therefore, all of parts, which are installed in a door latch device and electrically operate, are preferably integrally installed, by being mounted on the switch plate.

However, conventionally, sometimes, half closed door detection switches have been unable to be installed on the switch plates, and the half closed door detection switches have been installed separately from the switch plates. Further, conventionally, sometimes, half closed door detection switches have been installed on the switch plates, and intermediate members have been interposed between the half closed door detection switches and the latches. This has a problem that the assembly efficiency is reduced, since a step of installing the half closed door detection switches separately from the switch plates and a step of installing the intermediate members are required.

The present invention has been made in view of the above, and an object thereof is to provide a vehicle door latch device with improved assembly efficiency.

Solution to Problem

To solve the above-described problem and achieve the above-described object, a vehicle door latch device according to an embodiment of the present invention includes: an interlocking unit assembly including an interlocking mechanism provided in any one of a door and a vehicle body and configured to be able to hold the door in a closed position by engaging with a striker, which is provided in the other one of the door and the vehicle body and is configured to advance thereto along with closing movement of the door; and an operating unit assembly including an operating mechanism configured to be able to switch over the door between a locked state and an unlocked state. The interlocking unit assembly includes a latch configured to be rotatable to a latched position from an open position via a half closed door position by interlocking with the striker that has advanced thereto. The operating unit assembly includes: a casing, in which the interlocking unit assembly is fitted, and in which the operating mechanism is installed; and a switch plate, on which a half closed door detection switch and an electric wiring connected to the half closed door detection switch are installed, and which is integrally installed in the casing, the half closed door detection switch having a switch pin configured to abut against the latch in the open position and half closed door position or the latch in the latched position and to be pushed in by the latch. A plane of rotation of the latch and a plate surface of the switch plate intersect each other orthogonally.

In the vehicle door latch device according to the embodiment of the present invention, the operating unit assembly includes: a lock lever configured to be able to switch over the door between a locked position where the door is in the locked state and an unlocked position where the door is in the unlocked state; and a motor configured to be able to normally and reversely rotate so as to switch over the lock lever between the locked position and the unlocked position. The motor is mounted on the switch plate.

In the vehicle door latch device according to the embodiment of the present invention, the operating unit assembly includes a slide lever configured to be moved by lock and unlock operation of a key cylinder and configured to be able to switch over the lock lever between the locked position and the unlocked position. On the switch plate, a lock and unlock detection switch configured to detect position of the lock lever, and an electric wiring connected to the lock and unlock detection switch are installed. The motor is mounted at a position intermediate between the half closed door detection switch and the lock and unlock detection switch on the switch plate.

Advantageous Effects of Invention

According to the present invention, a vehicle door latch device with improved assembly efficiency is able to be realized.

DESCRIPTION OF EMBODIMENTS

Hereinafter, with reference to the drawings, an embodiment of a vehicle door latch device according to the present invention will be described. The present invention is not limited by this embodiment. Further, in describing the drawings, the same signs are appended to the same or corresponding elements, as appropriate.

EMBODIMENT

Figure 1:
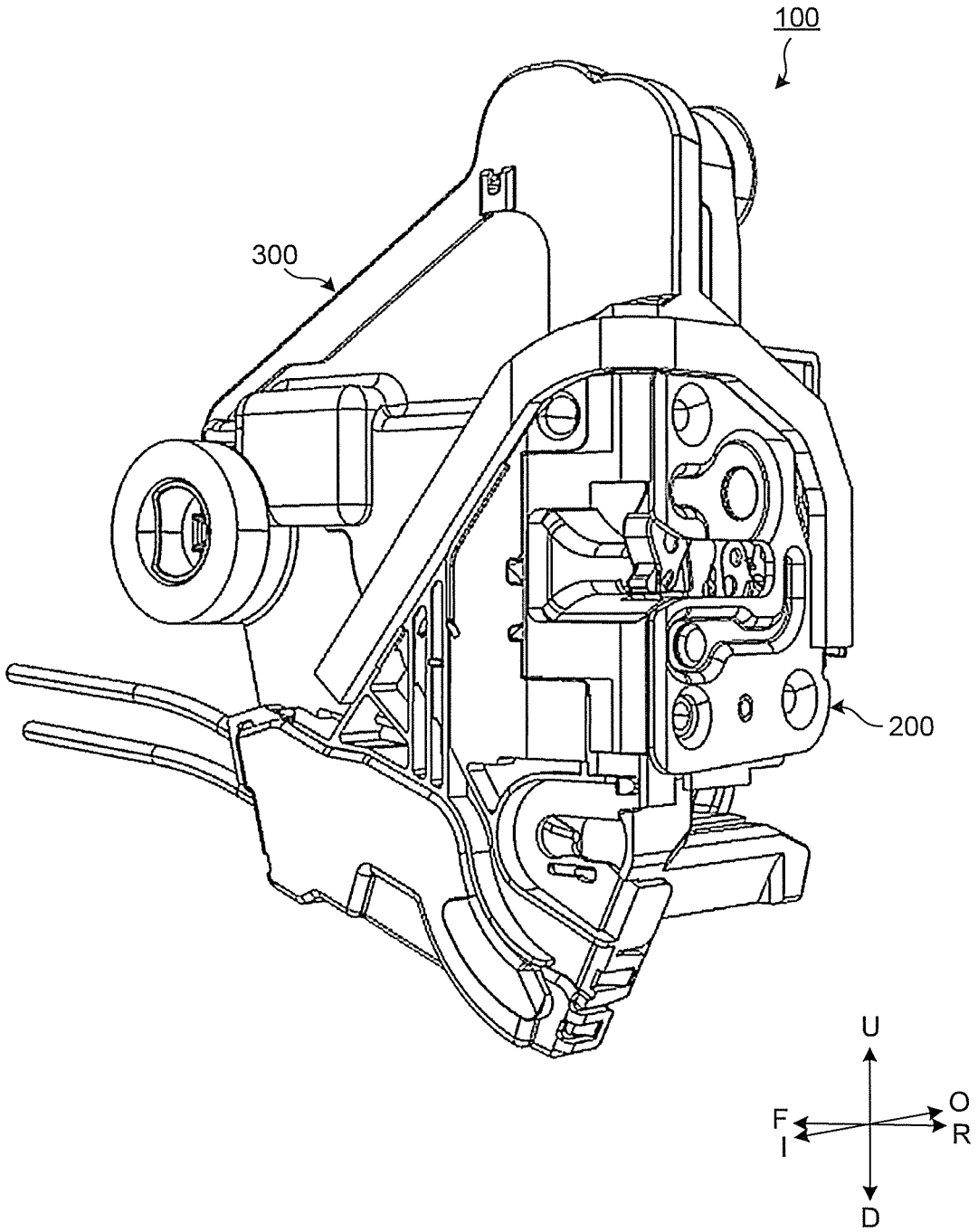
FIG. 1 is a perspective view of a vehicle door latch device according to an embodiment of the present invention.

Hereinafter, a vehicle door latch device according to this embodiment will be described, based on FIG. 1 to FIG. 14. FIG. 1 is a perspective view of the vehicle door latch device according to the embodiment of the present invention. In the following description, in a state where a door latch device 100 has been installed in a vehicle, the left in FIG. 1 will be referred to as "indoor side (I)", the right as "outdoor side (O)", the upside as "upside (U)", the downside as "downside (D)", the deeper side in the figure as "front (F)", and the shallower side in the figure as "rear (R)". These directions are defined for convenience of explanation, and of course, orientation of the door latch device 100 is modified depending on a type of the vehicle to be installed in, a position to be installed in, and the like.

The door latch device 100 of this embodiment is installed to a rear end portion in a front side door (hereinafter, abbreviated to "door") on a right side of an automobile, and is configured, by an interlocking unit assembly 200 being installed with an operating unit assembly 300, the interlocking unit assembly 200 for holding the door in a closed state by engaging with a vehicle body side striker, and the operating unit assembly 300 for operating the interlocking unit assembly 200.

Figure 2:
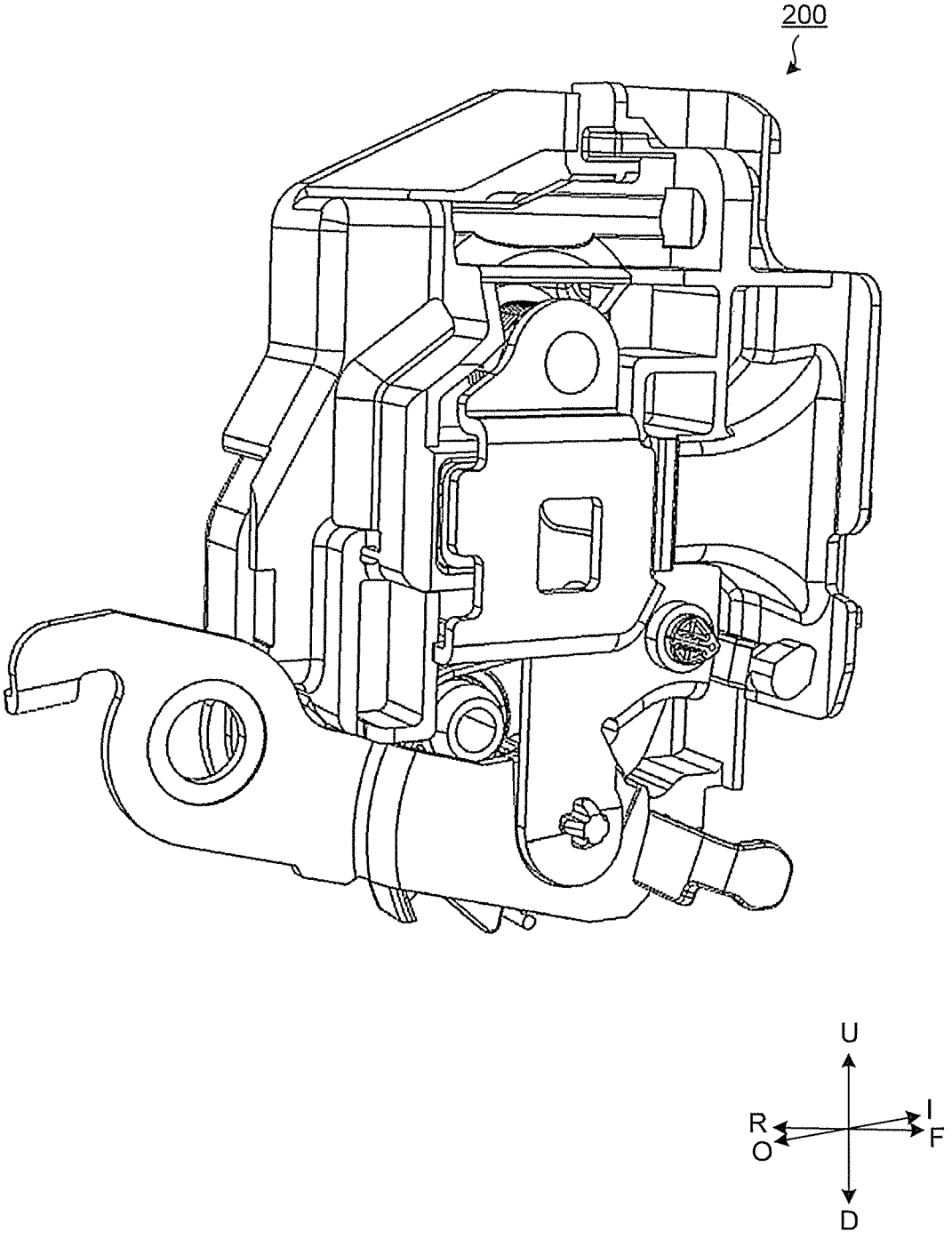
FIG. 2 is a perspective view of an interlocking unit assembly of the vehicle door latch device illustrated in FIG. 1.
Figure 3:
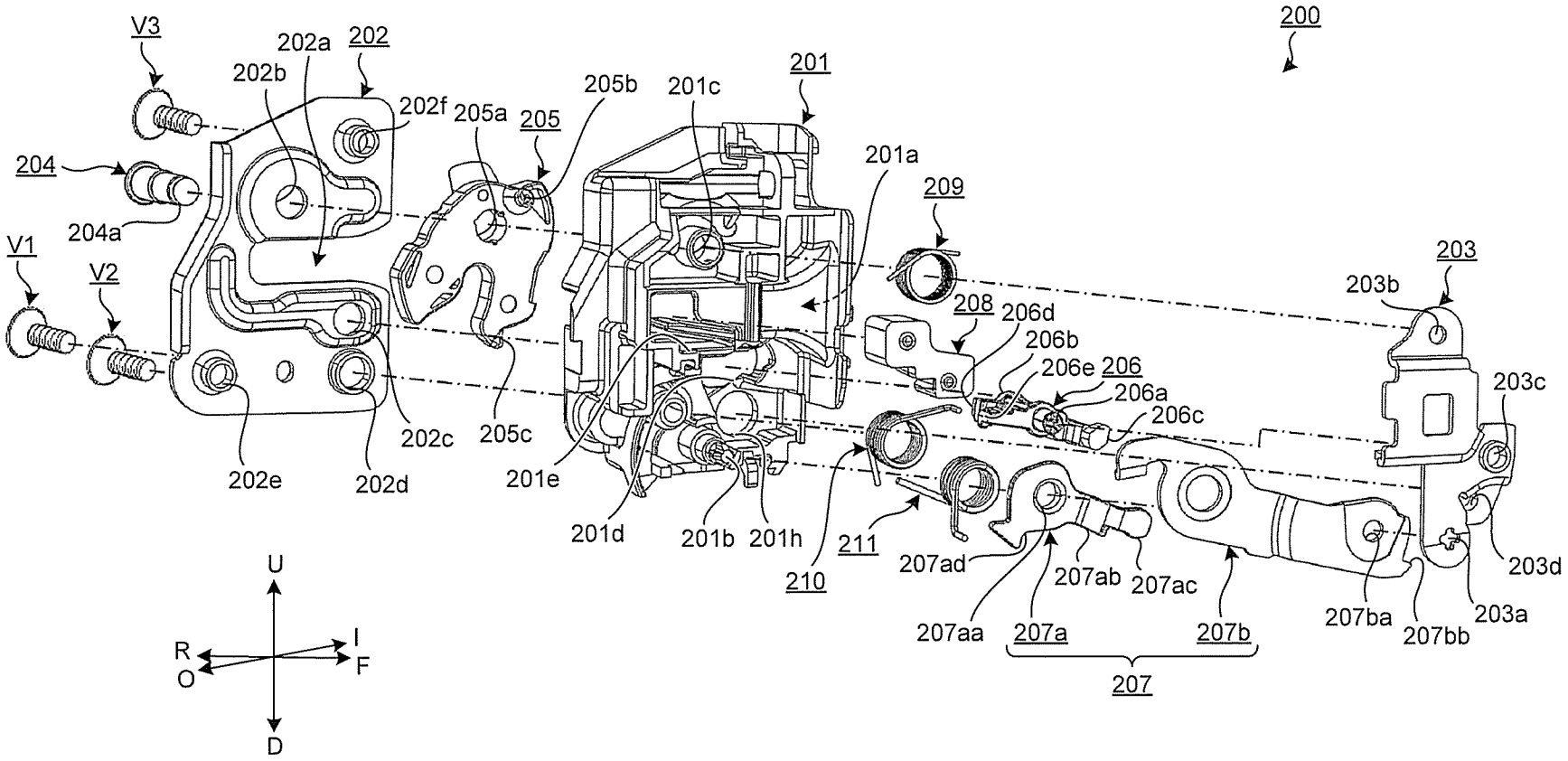
FIG. 3 is an exploded perspective view illustrating a configuration of the interlocking unit assembly illustrated in FIG. 2.

First of all, a configuration of the interlocking unit assembly 200 will be described. FIG. 2 is a perspective view of the interlocking unit assembly of the vehicle door latch device illustrated in FIG. 1. FIG. 3 is an exploded perspective view illustrating the configuration of the interlocking unit assembly illustrated in FIG. 2.

As illustrated in FIG. 3, the interlocking unit assembly 200 includes: a body 201; a cover plate 202 fixed to a rear side of the body 201; a back plate 203 fixed to a front side of the body 201; a latch shaft 204 inserted from a rear side; a latch 205 rotatably supported on the latch shaft 204; a pole 206 that restrains the door in a closed position by engaging with the latch 205; an outside lever 207 that releases the engagement between the latch 205 and the pole 206; and a bumper rubber 208 that abuts against the striker that has advanced thereto and the pole 206.

Next, each member of the interlocking unit assembly 200 will be described in detail.

The body 201 is formed of, for example, synthetic resin, and has a striker advancing groove 201*a*, into which the striker provided in the vehicle body advances along with closing movement of the door, the striker advancing groove 201*a* formed on one side (rear side) of the body 201.

The cover plate 202 is formed of, for example, various metals, has a notched portion 202*a*, into which the striker is able to advance, and is installed on a surface of the body 201, the surface at the rear side where the striker advancing groove 201*a* is formed.

The back plate 203 is formed of, for example, various metals, and is fixed by the latch shaft 204 and a bolt V1, with the cover plate 202 and the body 201 interposed therebetween. As a result, the interlocking unit assembly 200 is integrated. Further, the back plate 203 has a cross shaped hole 203*a*, into which a cross shaped projection formed at a distal end of a pivot shaft 201*b* of the body 201 is inserted.

The latch shaft 204 penetrates through a shaft hole 202*b* of the cover plate 202, a shaft hole 205*a* of the latch 205, and a shaft hole 201*c* of the body 201 from a rear side in this order, and a small diameter shaft portion 204*a* of a distal end portion thereof is substantially unrotatably pressed into a shaft hole 203*b* of the back plate 203.

The latch 205 is pivotably supported by the latch shaft 204, is accommodated inside the body 201 on the rear side thereof, interlocks with the striker that has advanced thereto, and rotates about the latch shaft 204 to a latched position from an open position via a half closed door position. Further, the latch 205 has an engagement portion 205*b* protruding to a front side.

Figure 4:
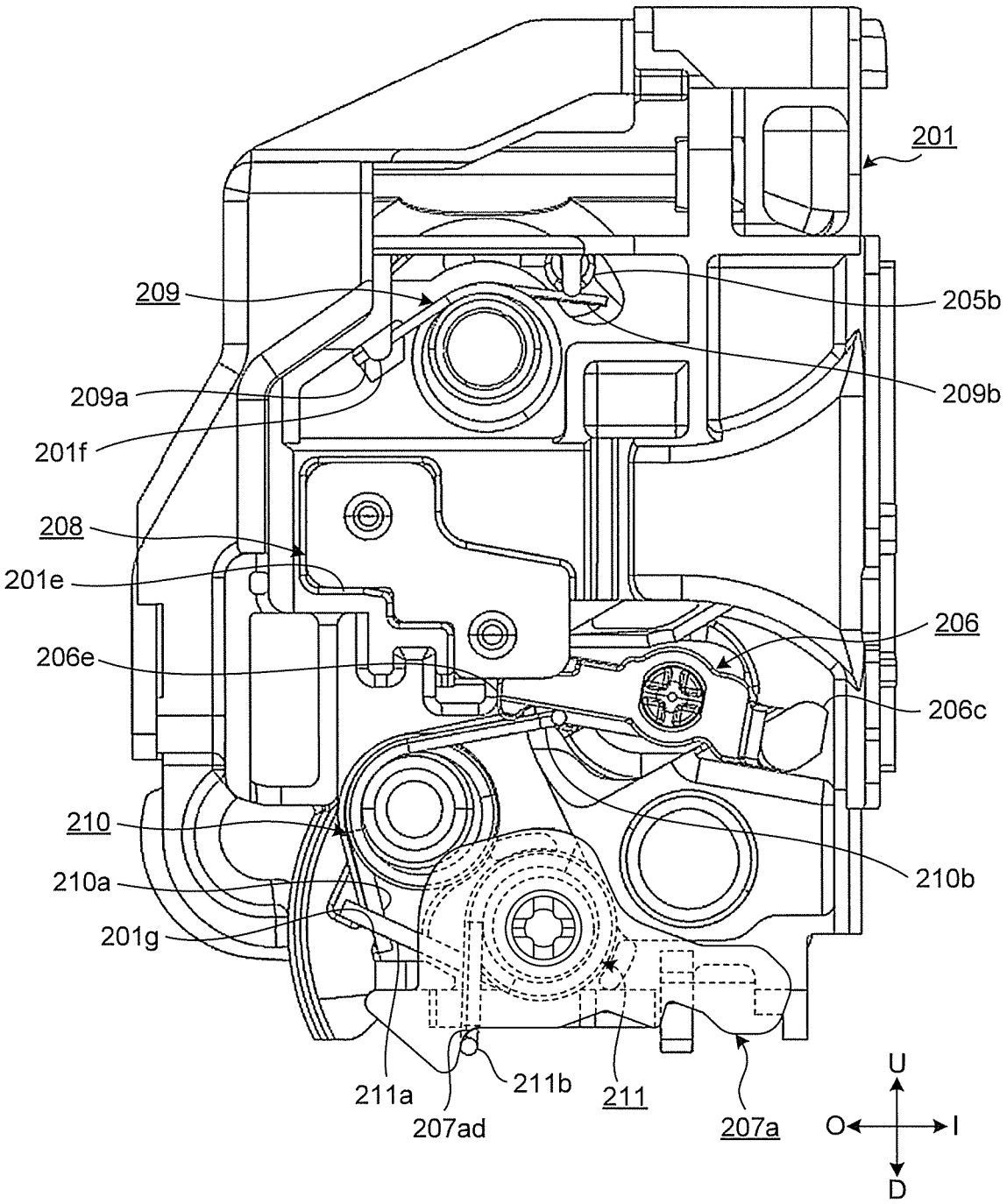
FIG. 4 is a front view illustrating an internal configuration of the interlocking unit assembly illustrated in FIG. 2.

FIG. 4 is a front view illustrating an internal configuration of the interlocking unit assembly illustrated in FIG. 2. FIG. 4 illustrates the latch 205 in the latched position. As illustrated in FIG. 4, the latch 205 is biased to rotate from the latched position to the open position (in an anticlockwise direction in FIG. 4) by the engagement portion 205*b* thereof engaging with a spring 209.

Returning to FIG. 3, the pole 206 is installed in a pole installation hole 201*d* formed in the body 201. Further, the pole 206 is pivotally supported to be turnable, with a shaft portion 206*a* at a front portion thereof being inserted through a shaft hole 203*c* of the back plate 203 and a shaft portion 206*b* at a rear portion thereof being inserted through a shaft hole 202*c* of the cover plate 202.

Next, FIG. 4 illustrates the pole 206 in an engaged position. The pole 206 is biased by a spring 210, to rotate from a released position where the engagement thereof with the latch 205 is released, in a direction towards the engaged position where the pole 206 is engageable with the latch 205 in the latched position. That is, the pole 206 is biased in a clockwise direction in FIG. 4.

Further, the pole 206 has a release lever 206*c* that releases the engagement thereof with the latch 205 by a later described release member 302 of the operating unit assembly 300 abutting against the release lever 206*c* and causing the pole 206 to rotate from the engaged position to the released position.

Figure 5:
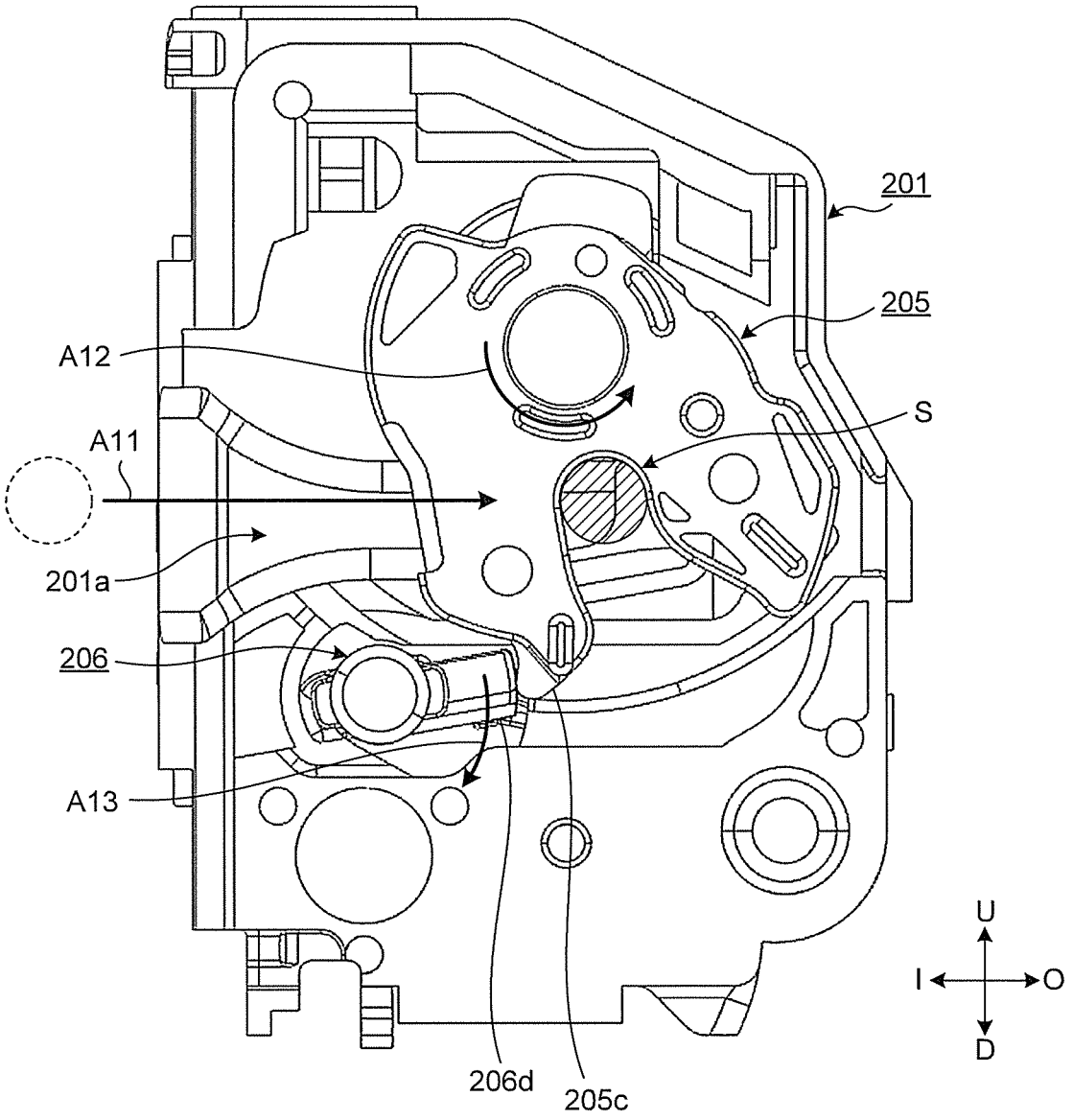
FIG. 5 is a rear view illustrating the internal configuration of the interlocking unit assembly illustrated in FIG. 2.

FIG. 5 is a rear view illustrating the internal configuration of the interlocking unit assembly illustrated in FIG. 2. FIG. 5 illustrates the pole 206 in the engaged position, and the pole 206 therein is biased in an anticlockwise direction. As a result, the pole 206 rotates from the engaged position to the released position in conjunction with rotation of the latch 205, rotates from the released position to the engaged position by the biasing force, and engages with the latch 205, to thereby restrain the door in the closed position. Further, the pole 206 has an engagement portion 206*d* that is engageable with the latch 205 that has interlocked with the striker S.

Returning to FIG. 3, the outside lever 207 has a structure divided into two, one being a first lever 207*a* having a shaft hole 207*aa*, through which the pivot shaft 201*b* of the body 201 is inserted, and the other being a second lever 207*b* overlapping a front side of this first lever 207*a* and having a shaft hole 207*ba*, through which the pivot shaft 201*b* of the body 201 is inserted. Each of the first lever 207*a* and the second lever 207*b* is rotatably supported by the pivot shaft 201*b*, by the pivot shaft 201*b* being inserted into the cross shaped hole 203*a* of the back plate 203, the pivot shaft 201*b* integrally formed forward with the body 201 to be parallel with the latch shaft 204.

As illustrated in FIG. 4, the first lever 207*a* is biased by a spring 211, so as to rotate from a released position to a standby position (in the clockwise direction in FIG. 4).

Figure 6:
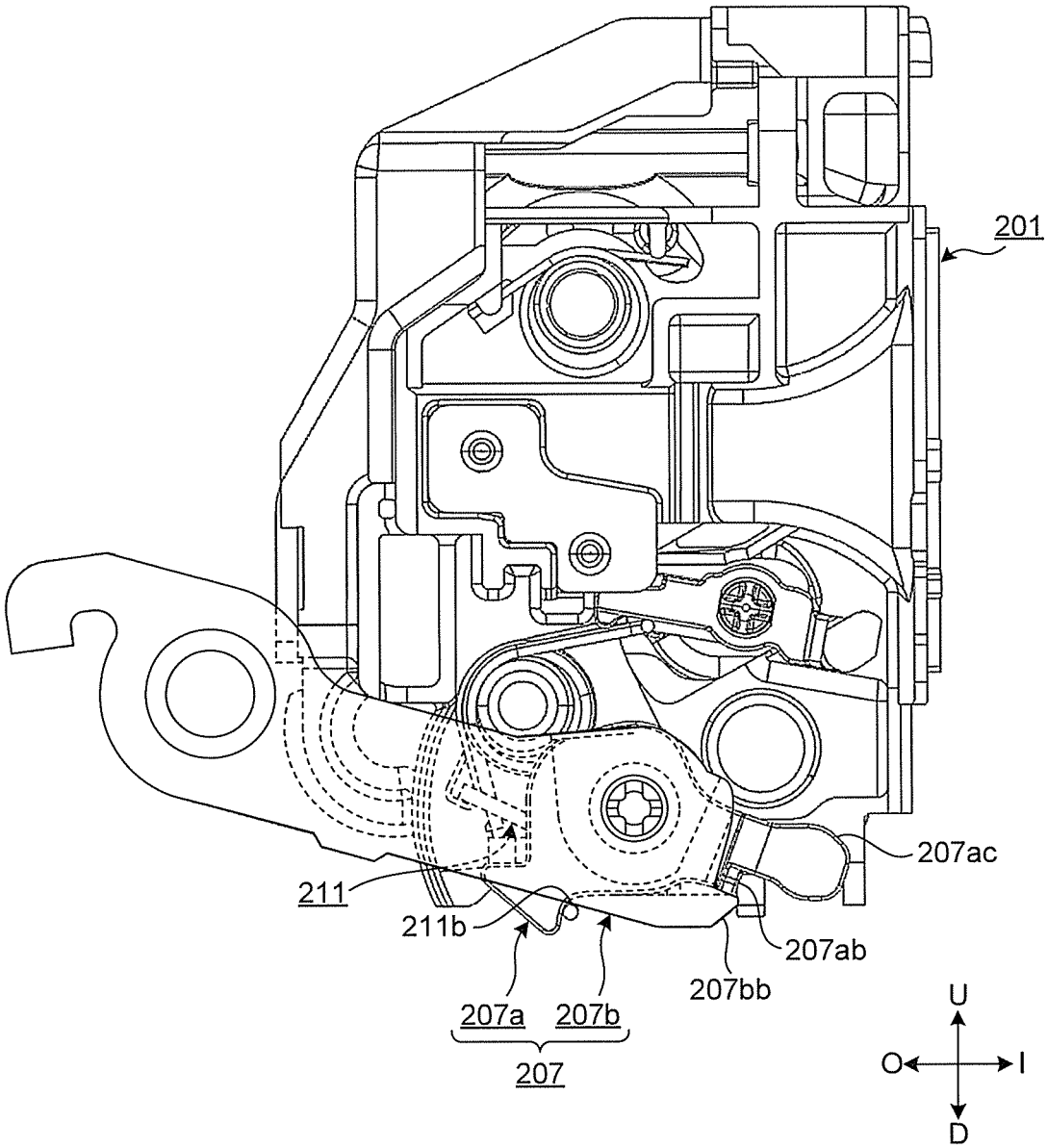
FIG. 6 is a front view illustrating a positional relation between a first lever and a second lever of the interlocking unit assembly illustrated in FIG. 2.

FIG. 6 is a front view illustrating a positional relation between the first lever and the second lever of the interlocking unit assembly illustrated in FIG. 2. As illustrated in FIG. 6, the second lever 207*b* is biased, by the spring 211, so as to rotate from a released position to a standby position (in a clockwise direction in FIG. 6).

By an engagement portion 207*bb* of the second lever 207*b* abutting against a lower surface of an engagement portion 207*ab* of the first lever 207*a*, the engagement portion 207*bb* protruding to the indoor side and claw shaped, and the engagement portion 207*ab* extending in a front-rear direction; the first lever 207*a* and the second lever 207*b* integrally move in conjunction therewith from the standby position illustrated in FIG. 6 to the released position (in the clockwise direction in FIG. 6).

An end portion of the second lever 207*b*, the end portion on the outdoor side, is coupled to an outside handle (illustration thereof omitted) provided on an outer panel of the door, via an operation force transmission member (illustration thereof omitted), such as a rod. When an opening operation is performed on the outside handle, via the later described release member 302 of the operating unit assembly 300 coupled to an end portion 207*ac* of the first lever 207*a*, the end portion 207*ac* on the indoor side, input based on the opening operation is placed on the release lever 206*c* of the pole 206 and the door is able to be opened.

That is, by rotating from the released position to the standby position based on the opening operation on the outside handle provided on the door and for opening the door from outside the vehicle body, the outside lever 207 is able to rotate the pole 206 moving in conjunction therewith from the released position to the engaged portion and to release the engagement between the latch 205 and the pole 206.

Returning to FIG. 4, the bumper rubber 208 is made of an elastic member, such as rubber, is installed in a bumper rubber installation hole 201*e* formed in the body 201, and absorbs impact by the striker S that has advanced thereto.

The spring 209 biases the latch 205, with one end portion 209*a* thereof being hooked on a hooked portion 201*f* of the body 201 at a front side, which is a shallower side of the plane of paper, and another end portion 209*b* thereof being hooked on the engagement portion 205*b* of the latch 205, respectively.

The spring 210 biases the pole 206, with one end portion 210*a* thereof being hooked on a hooked portion 201*g* of the body 201 and another end portion 210*b* thereof being hooked on an engagement portion 206*e* of the pole 206, respectively.

The spring 211 biases the first lever 207*a* and the second lever 207*b*, with one end portion 211*a* thereof being hooked on a hooked portion 201*g* of the body 201 and another end portion 211*b* thereof being hooked on an engagement portion 207*ad* of the first lever 207*a*, respectively.

Returning to FIG. 3, the bolt V1 penetrates through an attachment hole (illustration thereof omitted) of an inner panel of the door, a through hole 202*d* of the cover plate 202, and a through hole 201*h* of the body 201 in this order, and is screwed into a screw hole 203*d* of the back plate 203.

A bolt V2 and a bolt V3 penetrate through attachment holes (illustration thereof omitted) of the inner panel of the door and are screwed into a screw hole 202*e* and a screw hole 202*f* of the cover plate 202, respectively. The interlocking unit assembly 200 is fixed, together with the operating unit assembly 300, to the inner panel of the door, by these bolt V1 to bolt V3. Upon the fixing, by the bolt V1 being screwed into the screw hole 203*d* of the back plate 203 also, the back plate 203 is fixed to a reverse side of the body 201.

Next, operation of the interlocking unit assembly 200 will be described.

First, operation of the interlocking unit assembly 200 when the door is brought from an open state to the closed state will be described. When a door closing operation is performed, and as illustrated with an arrow A11 in FIG. 5, the striker S advances into the striker advancing groove 201*a* of the body 201, the latch 205 rotates, as illustrated with an arrow A12, from the open position to the latched position illustrated in FIG. 5 via the half closed door position. Further, the engagement portion 206*d* of the pole 206 is pushed down by abutting against the latch 205, and the pole 206 rotates in a direction of an arrow A13. Thereafter, the pole 206 rotates in a direction biased by the spring 210 (in the anticlockwise direction in FIG. 5) and an engagement portion 205*c* of the latch 205 engages with the engagement portion 206*d* of the pole 206. This state, where the striker S and the latch 205 are interlocked with each other, and the engagement portion 205*c* of the latch 205 and the engagement portion 206*d* of the pole 206 are engaged with each other, is the closed state of the door.

Next, operation of the interlocking unit assembly 200 when the door is brought from the closed state to the open state will be described. When, in the closed state of the door, input based on an opening operation on the handle is placed on the release lever 206*c* of the pole 206, the pole 206 rotates from the engaged position to the released position as illustrated with the arrow A13 in FIG. 5, and the engagement between the engagement portion 205*c* of the latch 205 and the engagement portion 206*d* of the pole 206 is released. The latch 205 is then rotated from the latched position to the open position by the biasing force and the interlock between the striker S and the latch 205 is released. When the door is further operated to be opened in an outdoor direction from this state, the door is brought into the open state. When the input based on the opening operation on the handle is canceled, the pole 206 rotates and returns from the released position to the engaged position by the biasing force of the spring 210.

Next, a configuration of the operating unit assembly 300 will be described. The operating unit assembly 300 has a function of: in an unlocked state, by an opening operation on the outside handle on the outdoor side of the door or on an inside handle on the indoor side of the door, releasing the engagement between the latch 205 of the interlocking unit assembly 200 and the striker to make the door openable; and in a locked state, even if an opening operation is performed on the outside handle or inside handle, making the door unopenable.

Figure 7:
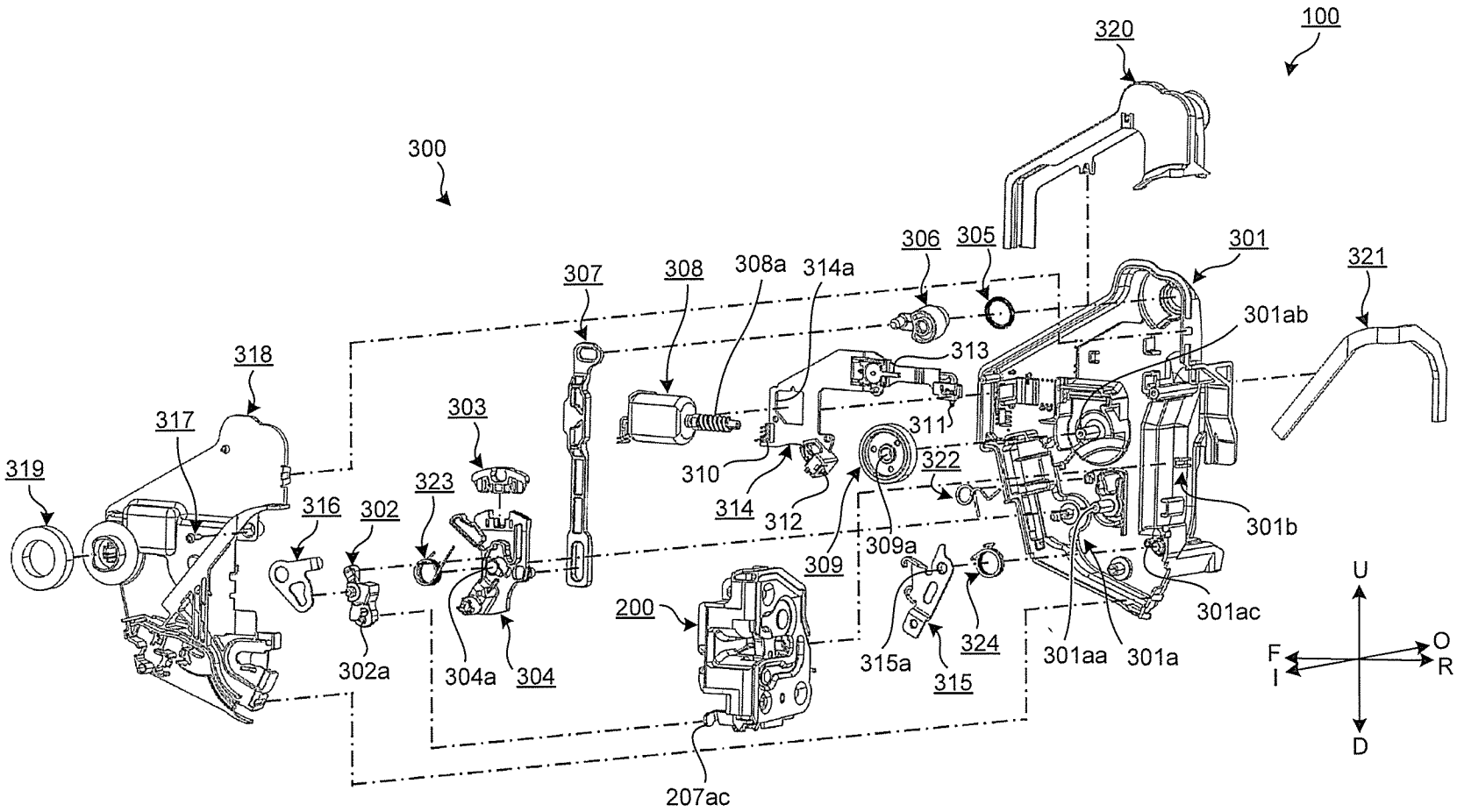
FIG. 7 is an exploded perspective view illustrating a configuration of an operating unit assembly of the vehicle door latch device illustrated in FIG. 1.

FIG. 7 is an exploded perspective view illustrating a configuration of the operating unit assembly of the vehicle door latch device illustrated in FIG. 1. As illustrated in FIG. 7, the operating unit assembly 300 is installed, together with the interlocking unit assembly 200, in a casing 301 that is substantially L-shaped in a plan view.

The operating unit assembly 300 includes: the release member 302, which engages with the above described first lever 207*a* of the outside lever 207; a lock lever 304, which engages with the release member 302, is fitted with a cam silencer 303, and is able to be switched over between a locked position and an unlocked position; a slide lever 307, which moves in conjunction with a key access 306 inserted through a ring 305, and is able to switch over the lock lever 304 between the locked position and the unlocked position; a motor 308 for locking and unlocking operation; a worm wheel 309, which is interlocked with a worm 308*a* fixed to a rotation axis of the motor 308 and with the cam silencer 303, and is able to switch over the lock lever 304 between the locked position and the unlocked position; a coupler 310; a half closed door detection switch 311, which detects position of the latch 205; a lock and unlock detection switch 312, which detects position of the lock lever 304; a switch plate 314, which is integrally installed in the casing 301, with a key switch 313 being coupled to the switch plate 314, the key switch detecting position of the slide lever 307; an inside lever 315, which makes the door openable by an opening operation on the inside handle; and a cancel lever 316 that engages with the release member 302.

The interlocking unit assembly 200 and the operating unit assembly 300 are accommodated in a case, which is formed of: the casing 301; a cover member 318, which covers an opening of the casing 301, the opening on the indoor side, is fixed to the casing 301 with a screw 317, and is made of synthetic resin; a coupler cushion 319, which is fitted to the cover member 318 from the outdoor side and protects an outer periphery of the coupler 310; a waterproof cover 320, which is fitted from above, is for preventing rainwater or the like from entering the case, and is made of synthetic resin; and a water proof seal 321, which is attached to a side surface of the cover member 318, the side surface on the indoor side, and prevents rainwater or the like from going to the indoor side.

Next, each member of the operating unit assembly 300 will be described in detail.

The casing 301 is made of, for example, synthetic resin, is fitted with the interlocking unit assembly 200, and installed with an operating mechanism of the operating unit assembly 300. The casing 301 includes: an operating unit assembly accommodating portion 301*a* with an indoor side thereof being open; and an interlocking unit assembly accommodating portion 301*b*, which extends out substantially perpendicularly from a rear end of this operating unit assembly accommodating portion 301*a* in an outdoor direction and is continuous with the operating unit assembly accommodating portion 301*a*.

The release member 302 moves in conjunction with the outside lever 207, with the end portion 207*ac* of the first lever 207*a* of the outside lever 207 being coupled to a coupling portion 302*a* thereof, the end portion 207*ac* on the indoor side. Further, the release member 302 abuts against and moves in conjunction with the inside lever 315 that rotates by an opening operation on the inside handle in the unlocked state.

A groove formed at an upper center of the cam silencer 303 engages with an engagement portion (illustration thereof omitted) formed on the outdoor side of the worm wheel 309.

The lock lever 304 is installed in the operating unit assembly accommodating portion 301*a* by a shaft tube 304*a* thereof being fitted, from the indoor side, to a support shaft 301*aa*, the shaft tube 304*a* oriented in an indoor-outdoor direction, and the support shaft 301*aa* projecting from a side surface of the operating unit assembly accommodating portion 301*a* and oriented to the indoor side. The lock lever 304 is respectively biased by a turn over spring 322 towards the locked position when the lock lever 304 is in the locked position and towards the unlocked position when the lock lever 304 is in the unlocked position.

Moreover, the shaft tube 304*a* of the lock lever 304 is inserted through a spring 323 and the release member 302 is installed from thereabove. As a result, the release member 302 is biased by the spring 323 in a direction (downwards in FIG. 7) in which the engagement with the pole 206 is released.

Further, the lock lever 304 is switched over, by operation of the slide lever 307 and the motor 308, between the locked position where the release member 302 is not engaged with the pole 206 and the unlocked position where the release member 302 is engaged with the pole 206.

The key access 306 is rotated by locking and unlocking operation of a key cylinder (illustration thereof omitted) provided in the outer panel of the door.

The slide lever 307 is installed in the operating unit assembly accommodating portion 301*a* from the indoor side. The slide lever 307 moves in an up-and-down direction in conjunction with rotation of the key access 306, and switches over the lock lever 304 between the locked position and the unlocked position.

The motor 308 is mounted on the switch plate 314 so that a bottom portion thereof fits in an opening 314*a* formed at an approximate center of the switch plate 314. The motor 308 switches over the lock lever 304 between the locked position and the unlocked position by the worm 308*a* fixed to the rotation axis interlocking with the worm wheel 309 and normally and reversely rotating.

The worm wheel 309 is installed in the operating unit assembly accommodating portion 301*a* from the indoor side by a shaft hole 309*a* at a center thereof being fitted to a support shaft 301*ab*, which projects from a central portion of the operating unit assembly accommodating portion 301*a* and faces the indoor side. Teeth formed on an outer periphery of the worm wheel 309 interlock with the worm 308*a* of the motor 308, and the engagement portion thereof formed on the outdoor side engages with the cam silencer 303. As a result, the worm wheel 309 switches over the lock lever 304 between the locked position and the unlocked position by the rotation of the motor 308.

The half closed door detection switch 311 detects a half closed state of the door, by abutting against the latch 205 in the open position and half closed door position and a switch pin thereof being pushed by the latch 205, and by not abutting against the latch 205 in the latched position and the switch pin not being pushed in. When the half closed state is detected, for example, a room lamp of the vehicle is turned on.

The lock and unlock detection switch 312 detects the locked and unlocked states of the door by a switch pin thereof being pushed in by the lock lever 304 in the unlocked position and the switch pin not being pushed in by the lock lever 304 in the locked position.

The key switch 313 detects position of the slide lever 307 and detects position of the key cylinder by a lever thereof engaging with the slide lever 307 and being switched up and down, the lever protruding to the rear side.

On a plate surface of the switch plate 314, the plate surface spreading in the front-rear direction and an up-down direction of the vehicle, the coupler 310, the half closed door detection switch 311, the lock and unlock detection switch 312, the key switch 313, and an electric wiring connected to each installed part are installed, and the switch plate 314 is integrally installed with the casing.

The inside lever 315 is installed in the operating unit assembly accommodating portion 301*a* from the indoor side by a shaft hole 315*a* at an upper end portion thereof being fitted with a support shaft 301*ac* provided in a protruding manner on a side surface of an end portion of the operating unit assembly accommodating portion 301*a*, the end portion on the rear side, and the support shaft 301*ac* oriented to the indoor side and inserted in a spring 324. The inside lever 315 is biased by the spring 324 so as to rotate in a direction of returning an opening operation by the inside handle to a standby state (in an anticlockwise direction in FIG. 7). In the unlocked state, the inside lever 315 makes the door openable by an opening operation on the inside handle.

The cancel lever 316 engages with the release member 302. By the cancel lever 316: when a locking operation is performed on a lock knob to bring the lock knob into the locked state in a state where the door is open, and the door is closed in that state, as the door becomes closed, the locked state is canceled and switched over to the unlocked state; and when a locking operation is performed on the lock knob to bring the lock knob into the locked state in the state where the door is open, and the door is closed while an opening operation is performed on the outside handle, the locked state is not canceled.

Next, operation of the operating unit assembly 300 will be described.

Figure 8:
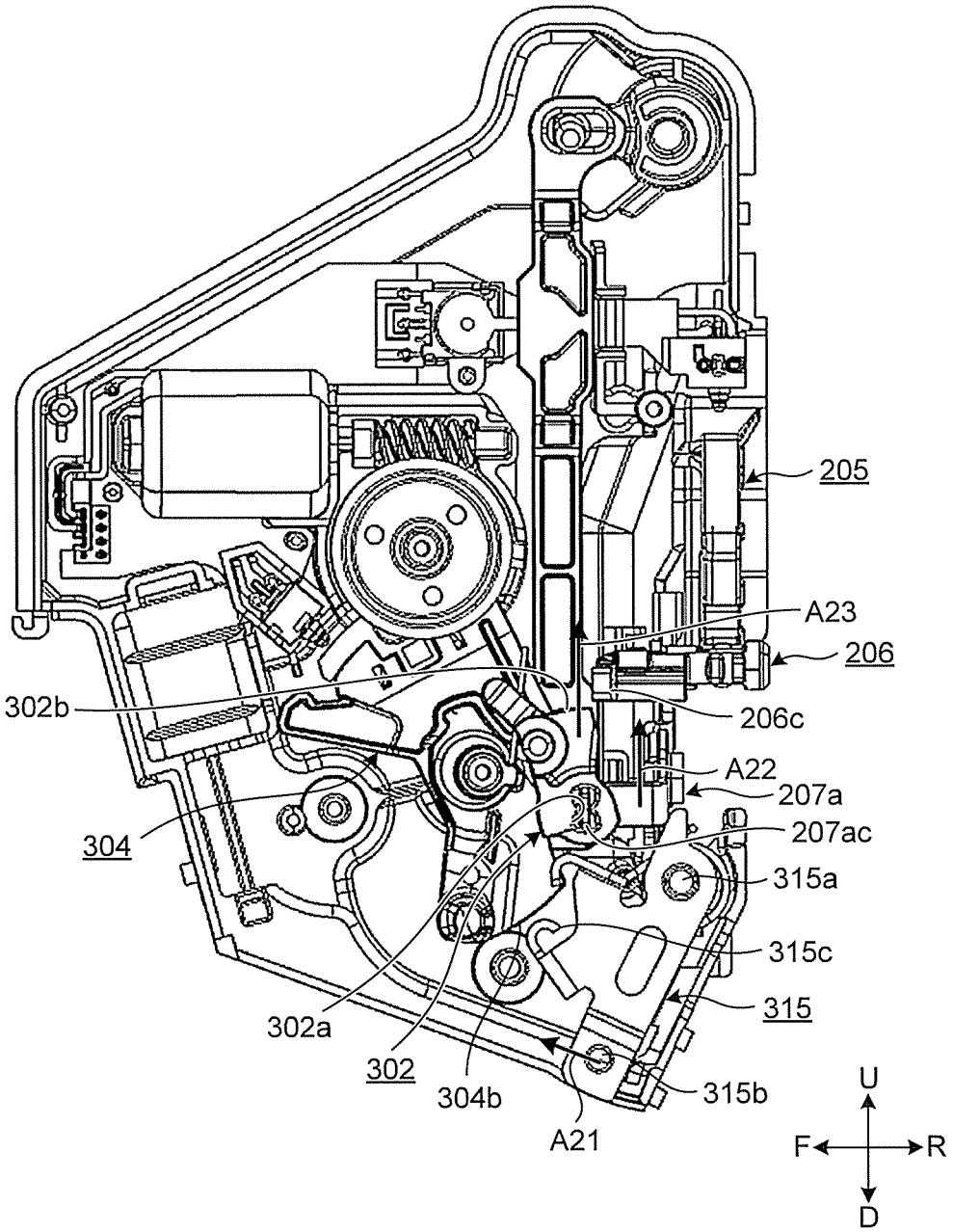
FIG. 8 is a diagram for explaining operation in a locked state of the operating unit assembly illustrated in FIG. 7.

First of all, a case where the door is in the locked state, that is, a case where the lock lever 304 is in the locked position, will be described. FIG. 8 is a diagram for explaining operation in the locked state of the operating unit assembly illustrated in FIG. 7. FIG. 8 is a diagram of the door latch device 100 as viewed from the indoor side, which is a shallower side of the plane of paper.

Firstly, as illustrated in FIG. 8, when a door opening operation is performed on the inside handle, an engagement portion 315*b* of the inside lever 315 is pulled in a direction of an arrow A21. That is, the inside lever 315 is added with force in a direction of rotating about the shaft hole 315*a*. When that happens, an engagement portion 315*c* of the inside lever 315 and an engagement portion 304*b* of the lock lever 304 abut against each other, and the inside lever 315 does not rotate. Therefore, the closed state of the door is maintained.

Next, when a door opening operation is performed on the outside handle, in conjunction with the second lever 207*b* of the outside lever 207, the first lever 207*a* of the outside lever 207 rotates in a direction of an arrow A22. When this happens, since the end portion 207*ac* of the first lever 207*a* and the coupling portion 302*a* of the release member 302 are coupled to each other, the release member 302 moves in conjunction with the rotation of the first lever 207*a*. Even if the release member 302 moves upwards as illustrated with an arrow A23 in the locked state, an engagement portion 302*b* of the release member 302 does not abut against and does not hit the release lever 206*c* of the pole 206, and thus the closed state of the door is maintained.

Accordingly, even if an opening operation is performed on the inside handle or the outside handle in the locked state, the operating unit assembly 300 operates such that the closed state of the door is maintained.

Figure 9:
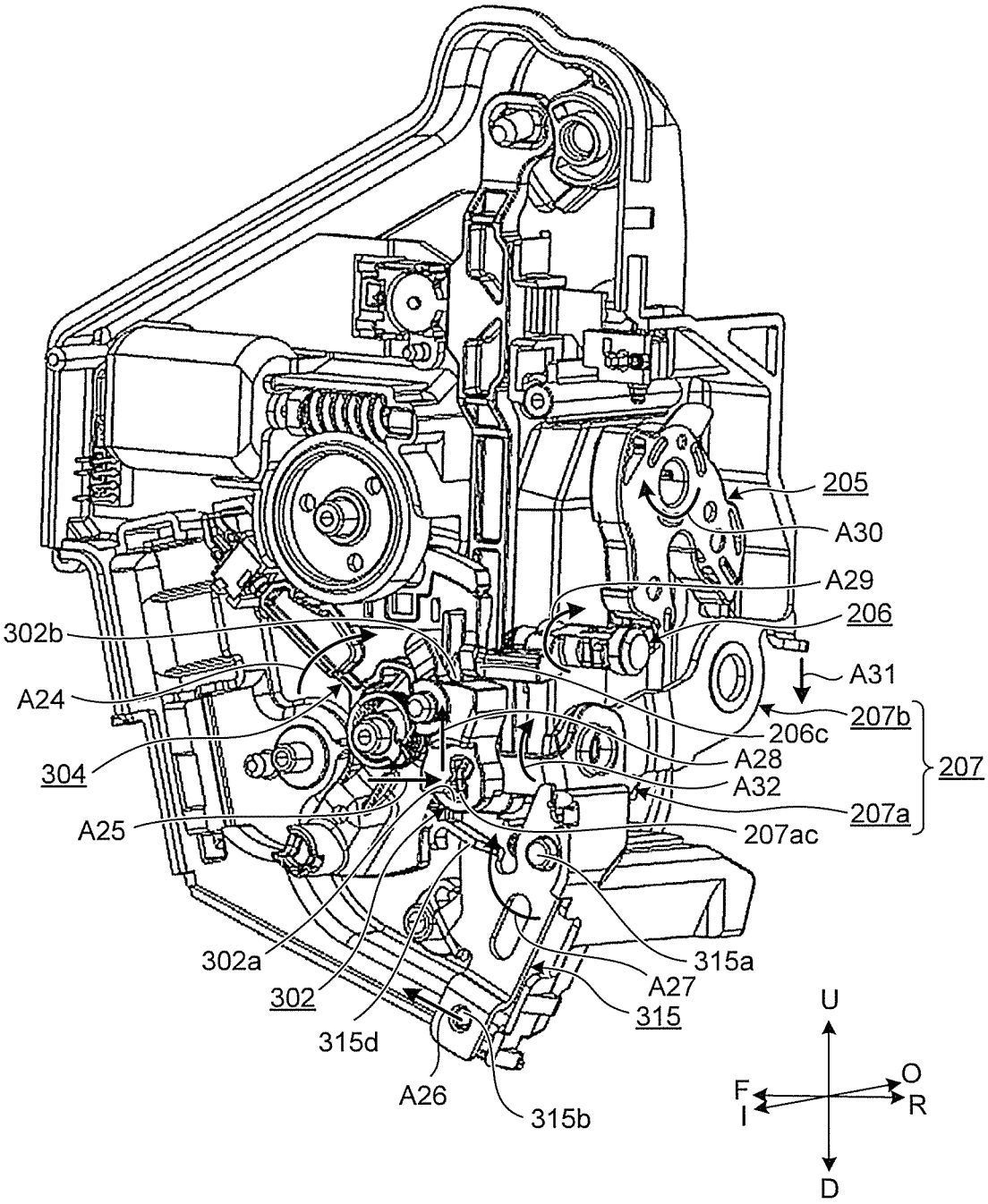
FIG. 9 is a diagram for explaining operation in an unlocked state of the operating unit assembly illustrated in FIG. 7.

Next, a case where the door is in the unlocked state, that is, a case where the lock lever 304 is in the unlocked position, will be described. FIG. 9 is a diagram for explaining operation in the unlocked state of the operating unit assembly illustrated in FIG. 7. FIG. 9 is a perspective view of the indoor side of the door latch device 100 as viewed from the rear side.

First, in the unlocked state of the door, the lock lever 304 is positioned in the unlocked position where the lock lever 304 has rotated in a clockwise direction from the locked position as illustrated with an arrow A24. In conjunction therewith, the release member 302 is positioned on a rearer side than the locked state as illustrated with an arrow A25.

As illustrated in FIG. 9, when a door opening operation is performed on the inside handle, the engagement portion 315*b* of the inside lever 315 is pulled in a direction of an arrow A26. The inside lever 315 then rotates about the shaft hole 315*a* as illustrated with an arrow A27. When that happens, an engagement portion 315*d* of the inside lever 315 and a lower end portion of the release member 302 abut against each other, and the release member 302 moves upwards as illustrated with an arrow A28. Further, in the unlocked state, since the engagement portion 302*b* of the release member 302 and the release lever 206*c* of the pole 206 abut against each other, the pole 206 rotates as illustrated with an arrow A29. As a result, the engagement between the pole 206 and the latch 205 is released, the latch 205 rotates as illustrated with an arrow A30, and the interlock between the latch 205 and the striker is released. When the door is operated to be opened in the outdoor direction from this state, the door is brought into the open state.

Next, when a door opening operation is performed on the outside handle, the second lever 207*b* of the outside lever 207 is pulled in a direction of an arrow A31. In conjunction with the second lever 207*b*, the first lever 207*a* of the outside lever 207 then rotates in a direction of an arrow A32. When this happens, since the end portion 207*ac* of the first lever 207*a* and the coupling portion 302*a* of the release member 302 are coupled to each other, the release member 302 moves upwards as illustrated with the arrow A28 in conjunction with the rotation of the first lever 207*a*. Since the engagement portion 302*b* of the release member 302 then abuts against the release lever 206*c* of the pole 206, the pole 206 rotates as illustrated with the arrow A29. As a result, the engagement between the pole 206 and the latch 205 is released, the latch 205 rotates as illustrated with an arrow A30, and the interlock between the latch 205 and the striker is released. When the door is operated to be opened in the outdoor direction from this state, the door is brought into the open state.

Accordingly, in the unlocked state, when an opening operation is performed on the inside handle or the outside handle, the operating unit assembly 300 operates so that the door is brought into the open state.

Conventionally, half closed door detection switches that detect position of latches have been unable to be installed directly on switch plates, and thus sometimes half closed door detection switches have been installed separately from switch plates. Further, intermediate members have sometimes been interposed between half closed door detection switches and latches.

First, since latches interlock with strikers, a direction in which rod like interlocking portions of the strikers extend (front-rear direction of the vehicle) orthogonally intersects a plane of rotation of the latches (plane in up-down and left-right directions of the vehicles). Since door latch devices are installed in doors, the door latch devices are limited by thickness of the doors in a left-right direction of the vehicles, and thus have a shape extending in the front-rear direction and up-down direction of the vehicles, and plate surfaces of the switch plates also have a shape extending in the front-rear direction and up-down direction of the vehicles. Accordingly, the plane of rotation of the latches and the plate surfaces of the switch plates intersect each other orthogonally.

Next, half closed door detection switches have switch pins for detecting position of the latches. Conventionally, the surface on which a half closed door detection switch is installed and the driving surface of the member that pushes in the switch pin have been set to be on the same plane.

Therefore, conventionally, the half closed door detection switch arranged on the same plane as that of the plane of rotation of the latch has sometimes been installed separately from the switch plate having a plate surface orthogonally intersecting the plane of rotation of the latch. Further, in conventional door latch devices, sometimes, the half closed door detection switches have been installed on the switch plates and intermediate members have been interposed therebetween.

Figure 10:
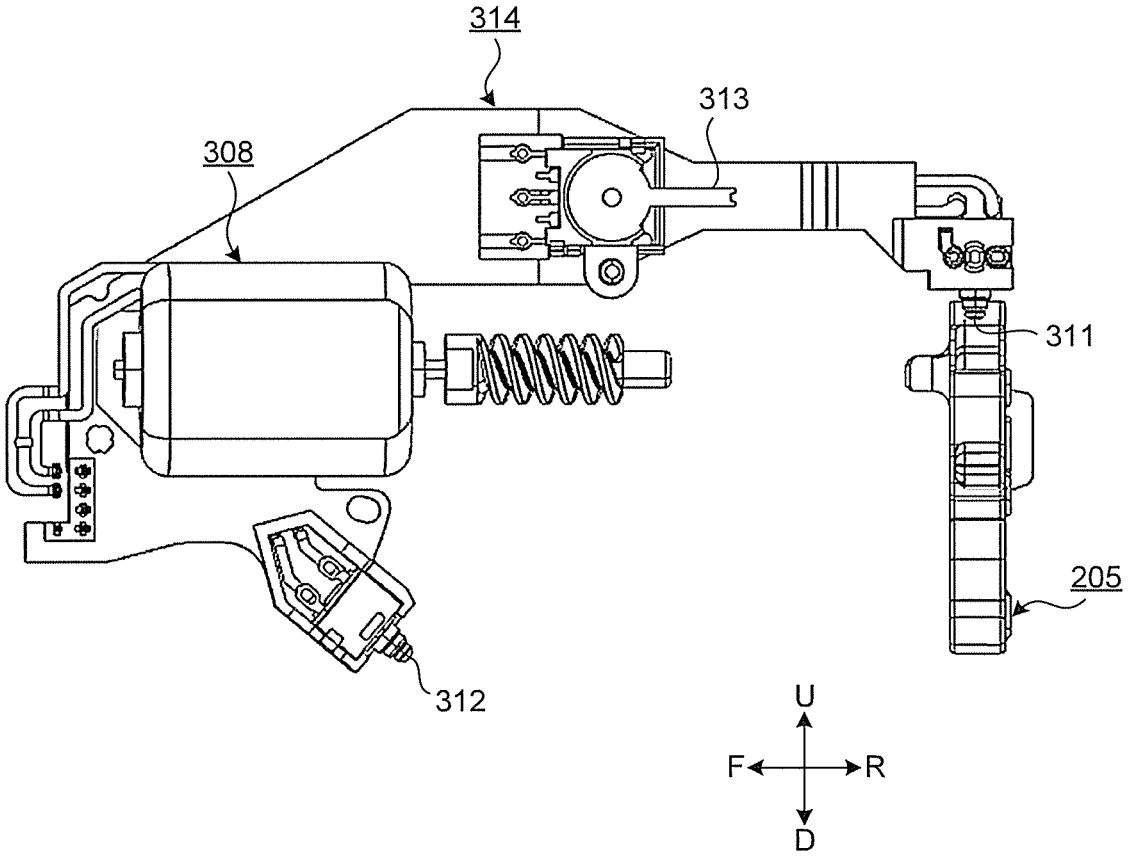
FIG. 10 is a diagram illustrating a positional relation between a latch and a switch plate of the vehicle door latch device illustrated in FIG. 1.

In contrast, in the door latch device 100, the half closed door detection switch 311 is configured to be installed on the switch plate 314, and the latch 205 is configured to directly push in the switch pin of the half closed door detection switch 311. FIG. 10 is a diagram illustrating a positional relation between the latch and the switch plate of the vehicle door latch device illustrated in FIG. 1. As illustrated in FIG. 10, in the door latch device 100, the plane of rotation of the latch 205 and the plate surface of the switch plate 314 on which the half closed door detection switch 311 is installed intersect each other orthogonally. The door latch device 100 is designed such that the latch 205 directly pushes in the switch pin of the half closed door detection switch 311, the latch 205 rotating in a direction orthogonal to the plate surface of the switch plate 314, and the plate surface being a surface on which the switch pin is installed.

Figure 11:
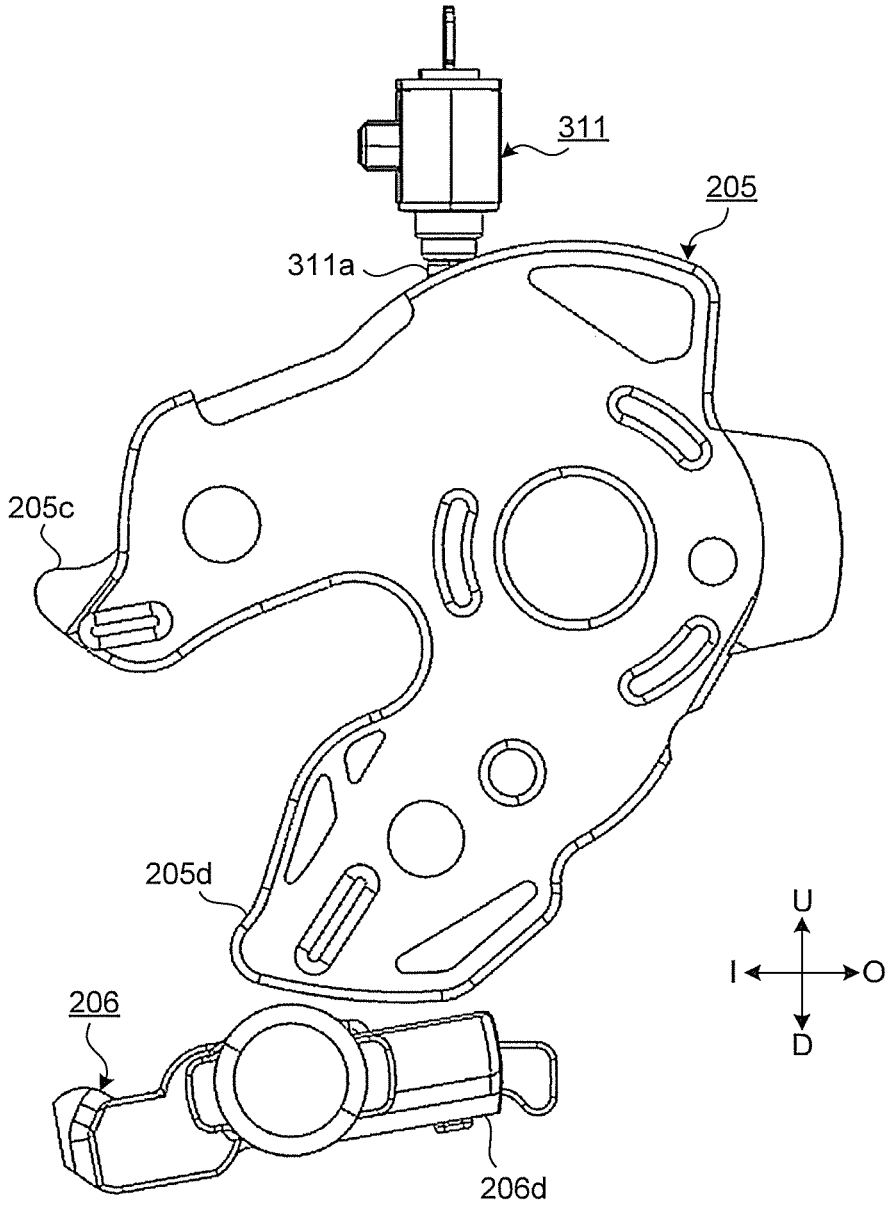
FIG. 11 is a diagram illustrating a positional relation between the latch in an open position and a half closed door detection switch.

The operation of the half closed door detection switch 311 will now be described in more detail. FIG. 11 is a diagram illustrating a positional relation between the latch in the open position and the half closed door detection switch. In the open position, the latch 205 and the pole 206 are not engaged with each other. As illustrated in FIG. 11, the half closed door detection switch 311 abuts against the latch 205 that is in the open position and a switch pin 311*a* thereof is pushed in by the latch 205.

Figure 12:
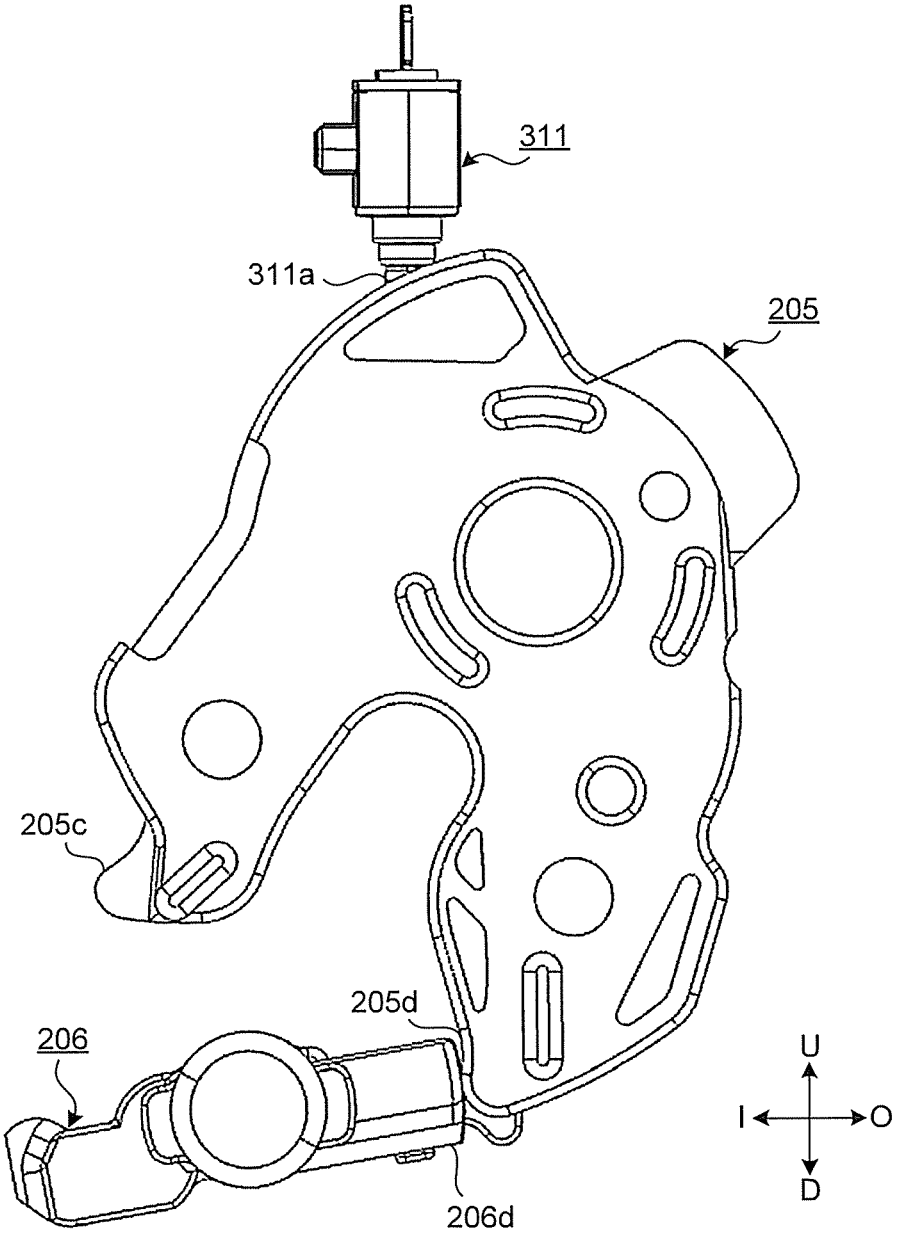
FIG. 12 is a diagram illustrating a positional relation between the latch in a half closed door position and the half closed door detection switch.

FIG. 12 is a diagram illustrating a positional relation between the latch in the half closed door position and the half closed door detection switch. In the half closed door position, an engagement portion 205*d* of the latch 205 and the engagement portion 206*d* of the pole 206 are engaged with each other. As illustrated in FIG. 12, the half closed door detection switch 311 abuts against the latch 205 that is in the half closed door position and the switch pin 311*a* thereof is pushed in by the latch 205.

Figure 13:
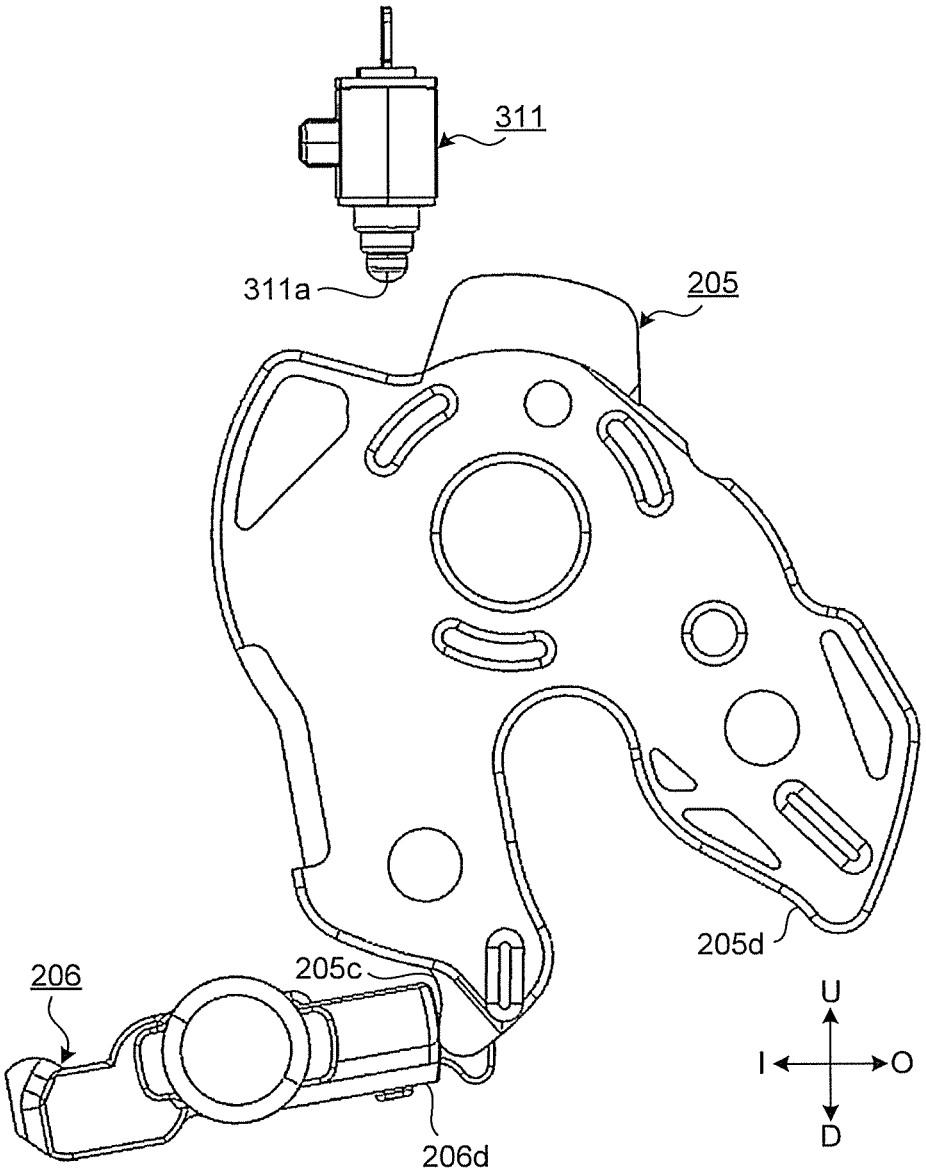
FIG. 13 is a diagram illustrating a positional relation between the latch in a latched position and the half closed door detection switch.

FIG. 13 is a diagram illustrating a positional relation between the latch in the latched position and the half closed door detection switch. In the latched position, the engagement portion 205*c* of the latch 205 and the engagement portion 206*d* of the pole 206 are engaged with each other. As illustrated in FIG. 13, the half closed door detection switch 311 does not abut against the latch 205 that is in the latched position and the switch pin 311*a* thereof is not pushed in.

Therefore, the half closed door detection switch 311 detects the state where the switch pin 311*a* has been pushed in as the open position or the half closed door position, and the state where the switch pin 311*a* has not been pushed in as the latched position.

As described above, in the door latch device 100, the plane of rotation of the latch 205 and the plate surface of the switch plate 314 intersect orthogonally to each other, and the half closed door detection switch 311 is installed on the switch plate 314. As a result, in the door latch device 100, all of the parts that electrically operate, including the half closed door detection switch 311, are able to be installed on the switch plate 314 and, further, there is no need to interpose any intermediate member between the latch 205 and the half closed door detection switch 311. Therefore, the door latch device 100 is a vehicle door latch device with improved assembly efficiency.

Further, conventionally, since plural parts that electrically operate, such as a motor and various switches, which are at separate positions in the door latch device, have been mounted on a switch plate, the switch plate has had an elongated arm shape and has been configured to be mounted with the respective parts on a distal end thereof. Therefore, there has been a problem that the configuration of the casing has been complicated, because a measure has needed to be taken, such as provision of a fitting portion in the casing so that the arm portion does not float from the casing.

In contrast, in the door latch device 100, the motor 308 is mounted on the switch plate 314. As a result, the motor 308 holds down the switch plate 314 and floating of the switch plate 314 is lessened. Therefore, there is no need to provide a fitting portion in the casing 301 and complication of the casing 301 is able to be prevented.

Figure 14:
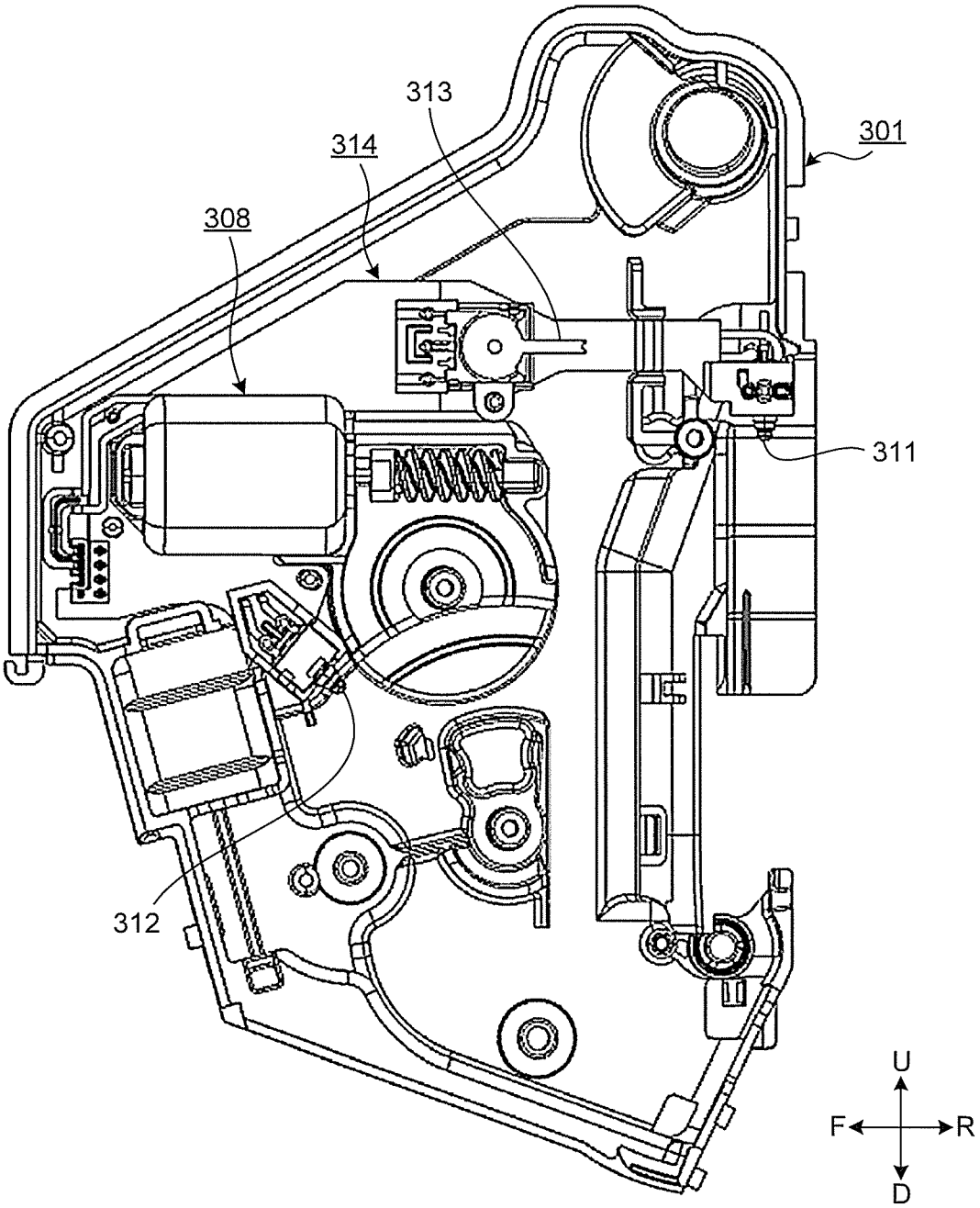
FIG. 14 is a diagram for explaining the switch plate of the operating unit assembly illustrated in FIG. 7.

FIG. 14 is a diagram for explaining the switch plate of the operating unit assembly illustrated in FIG. 7. As illustrated in FIG. 14, in the door latch device 100, the motor 308 is mounted at a position intermediate between the half closed door detection switch 311 and the lock and unlock detection switch 312 on the switch plate 314. As a result, the motor 308 is positioned at an approximate center of the switch plate 314, the motor 308 holds down the switch plate 314, and the effect of lessening the floating of the switch plate 314 becomes more prominent.

As described above, the door latch device 100 according to this embodiment is a vehicle door latch device with improved assembly efficiency.

According to the above description of the embodiment, the vehicle door latch device is provided on the door side and the striker is provided on the vehicle body side, but the present invention is not limited to this embodiment. That is, the present invention is also adaptable to a case where the vehicle door latch device is provided on the vehicle body side and the striker is provided on the door side.

Further, according to the above description of the embodiment, the vehicle door latch device is installed in the front side door of the automobile, but the vehicle door latch device of the present invention may be installed in a rear door, of course.

Furthermore, according to the above description of the embodiment, the vehicle door latch device is installed in the right side door of the automobile, but when the vehicle door latch device of the present invention is installed in a left side door of an automobile, the vehicle door latch device may be configured to be symmetrical therewith about a plane along the front-rear direction of the vehicle.

Moreover, according to the above description of the embodiment, the half closed door detection switch 311 abuts against the latch 205 in the open position and half closed door position and the switch pin thereof is pushed in by the latch 205, but the present invention is not limited to this embodiment. That is, the half closed door detection switch may be configured to detect the half closed state of the door by abutting against the latch in the latched position and the switch pin being pushed in by the latch, and by the switch pin not being pushed in by the latch in the open position and half closed door position.

In addition, the present invention is not limited by the above described embodiment. Those configured by combining as appropriate the respective components described above are also included in the present invention. Moreover, further effects and modifications can be easily derived by those skilled in the art. Therefore, wider aspects of the present invention are not limited to the above described embodiment and various modifications may be made.

INDUSTRIAL APPLICABILITY

As described above, the vehicle door latch device according to the present invention is useful for improving assembly efficiency of the vehicle door latch device.

REFERENCE SIGNS LIST

100 DOOR LATCH DEVICE
200 INTERLOCKING UNIT ASSEMBLY
201 BODY
201*a* STRIKER ADVANCING GROOVE
201*b* PIVOT SHAFT
201*c*, 202*b*, 202*c*, 203*b*, 203*c*, 205*a*, 207*aa*, 207*ba*, 309*a*, 315*a* SHAFT HOLE
201*d* POLE INSTALLATION HOLE
201*e* BUMPER RUBBER INSTALLATION HOLE
201*f*, 201*g* HOOKED PORTION
201*h*, 202*d* THROUGH HOLE
202 COVER PLATE
202*a* NOTCHED PORTION
202*e*, 202*f*, 203*d* SCREW HOLE
203 BACK PLATE
203*a* CROSS SHAPED HOLE
204 LATCH SHAFT
204*a* SMALL DIAMETER SHAFT PORTION
205 LATCH
205*b*, 205*c*, 205*d*, 206*d*, 206*e*, 207*ab*, 207*ad*, 207*bb*, 302*b*, 304*b*, 315*b*, 315*c*, 315*d* ENGAGEMENT PORTION
206 POLE
206*a*, 206*b* SHAFT PORTION
206*c* RELEASE LEVER
207 OUTSIDE LEVER
207*a* FIRST LEVER
207*ac*, 209*a*, 209*b*, 210*a*, 210*b*, 211*a*, 211*b* END PORTION
207*b* SECOND LEVER
208 BUMPER RUBBER
209, 210, 211, 323, 324 SPRING
300 OPERATING UNIT ASSEMBLY
301 CASING
301*a* OPERATING UNIT ASSEMBLY ACCOMMODATING PORTION
301*aa*, 301*ab*, 301*ac* SUPPORT SHAFT
301*b* INTERLOCKING UNIT ASSEMBLY ACCOMMODATING PORTION
302 RELEASE MEMBER
302*a* COUPLING PORTION
303 CAM SILENCER
304 LOCK LEVER
304*a* SHAFT TUBE
305 RING
306 KEY ACCESS
307 SLIDE LEVER
308 MOTOR
308*a* WORM
309 WORM WHEEL
310 COUPLER
311 HALF CLOSED DOOR DETECTION SWITCH
311*a* SWITCH PIN
312 LOCK and UNLOCK DETECTION SWITCH
313 KEY SWITCH
314 SWITCH PLATE
314*a* OPENING
315 INSIDE LEVER
316 CANCEL LEVER
317 SCREW
318 COVER MEMBER
319 COUPLER CUSHION
320 WATERPROOF COVER
321 WATERPROOF SEAL
322 TURN OVER SPRING
V1, V2, V3 BOLT
A11, A12, A13, A21, A22, A23, A24, A25, A26, A27, A28, A29, A30, A31, A32 ARROW
S STRIKER

The invention claimed is:

1. A vehicle door latch device, comprising:

an interlocking unit assembly including an interlocking mechanism provided in one of a door and a vehicle body and configured to be able to hold the door in a closed position by engaging with a striker, which is provided in the other one of the door and the vehicle body and is configured to advance into engagement with the interlocking mechanism along with closing movement of the door; and an operating unit assembly including an operating mechanism configured to be able to switch over the door between a locked state and an unlocked state, wherein the interlocking mechanism includes a latch configured to be rotatable to a latched position from an open position via a half closed door position by interlocking with the striker that has advanced into engagement with the latch, the operating unit assembly includes:

a casing, in which the interlocking unit assembly is fitted, and in which the operating mechanism is installed; and a switch plate, having a plate surface that extends in a longitudinal direction of the switch plate and on which a half closed door detection switch and an electric wiring connected to the half closed door detection switch are installed, and which is integrally installed in the casing, the half closed door detection switch having a switch pin configured to abut against the latch and to be pushed in by the latch in the open position and the half closed door position, and configured to be separated from the latch in the latched position, and a plane of rotation of the latch and the plate surface intersect each other orthogonally.

2. The vehicle door latch device according to claim 1, wherein the operating mechanism includes:

a lock lever configured to be able to switch between a locked position where the door is in the locked state and an unlocked position where the door is in the unlocked state; and a motor configured to be able to rotate so as to switch the lock lever between the locked position and the unlocked position, and the motor is mounted on the switch plate.

3. The vehicle door latch device according to claim 2, wherein the operating unit assembly further includes a slide lever configured to be moved by lock and unlock operation of a key cylinder and configured to be able to switch over the lock lever between the locked position and the unlocked position, located on the switch plate is a lock and unlock detection switch configured to detect the position of the lock lever, and an electric wiring connected to the lock and unlock detection switch, and the motor is mounted at a position intermediate between the half closed door detection switch and the lock and unlock detection switch on the switch plate.

* * * * *